United States Patent [19]

Kaelber

[11] 4,257,233

[45] Mar. 24, 1981

[54] FASTENING ARRANGEMENT ESPECIALLY FOR A TURBINE AND A CONDENSER

[75] Inventor: Gunter Kaelber, Birmenstorf, Switzerland

[73] Assignee: BBC Brown Boveri & Company Limited, Baden, Switzerland

[21] Appl. No.: 22,628

[22] Filed: Mar. 21, 1979

[30] Foreign Application Priority Data

Mar. 21, 1978 [CH] Switzerland ..... 3059/78

[51] Int. Cl.[3] ..... F01D 25/28; F01K 11/02

[52] U.S. Cl. ..... 60/687; 60/690

[58] Field of Search ..... 60/687, 690, 692

[56] References Cited

U.S. PATENT DOCUMENTS 1,751,602 3/1930 Ray ..... 60/687

3,074,236 1/1963 Caldwell et al. ..... 60/687

FOREIGN PATENT DOCUMENTS 1551192 4/1970 Fed. Rep. of Germany ..... 60/690

2055354 4/1972 Fed. Rep. of Germany ..... 60/692

*Primary Examiner*—James J. Gill

*Attorney, Agent, or Firm*—Burns, Doane, Swecker & Mathis

[57] ABSTRACT

A fastening arrangement for a turbine and a condenser is disclosed wherein the turbine and the condenser are fastened to a common foundation table in order to decrease the effect of dynamic loads on the machine parts of a turbine and its foundations. The foundation table is spring-supported on a plurality of supports of another supporting structure. A flexible connection is provided between the turbine and the condenser with one of the bearing members of the arrangement being located variously about the foundation table. One of the bearing members is preferably arranged on a top surface of the foundation table and another bearing member may be arranged below or within the foundation table. Furthermore, the other bearing member may be cast within the foundation table or be resiliently mounted for axial movement within a recess of the table.

12 Claims, 5 Drawing Figures

FASTENING ARRANGEMENT ESPECIALLY FOR A TURBINE AND A CONDENSER

BACKGROUND AND SUMMARY OF THE PRESENT INVENTION

The present invention relates generally to a fastening device and more specifically relates to a fastening device for a turbine and a condenser.

Various proposals have already been made both for fastening a turbine and a condenser as well as for the connection of the turbine and condenser together. The best-known and most used forms of construction have the turbine rigidly supported on a foundation table. The condenser is likewise rigidly supported but independently from the turbine on a building foundation. A flexible connection is provided between both machine parts in an arrangement as is disclosed in U.S. Pat. No. 1,881,443 of Warren B. Flanders, filed on Oct. 11, 1932.

It is especially disadvantageous in these well known arrangements that the foundation parts cannot be spring-supported. Furthermore, an especially heavy foundation is required having a relatively large space requirement since the atmospheric load must be completely absorbed by the foundation.

In other known arrangements, turbine/condenser fastenings have been designed in which the turbine is connected rigidly to the condenser such as is disclosed in U.S. Pat. No. 1,369,668 of Oscar Junggren, filed on Feb. 22, 1921. In such construction, however, the disadvantage appears that the dynamic loads act reciprocally on the machine elements. Furthermore, the practical embodiment of such an arrangement is relatively expensive.

It is a primary object of the present invention to provide a fastening arrangement for a condenser and a turbine in which the atmospheric load does not have to be absorbed by the foundation and wherein a simple space-saving foundation configuration is possible.

The abovementioned object and others are solved according to the present invention in that the turbine and the condenser are fastened to a common foundation table. The foundation table is then spring-supported by supports of a carrying structure.

The advantage of such an arrangement according to the present invention is more particularly to be seen in that all the forces of the turbine and the condenser are transmitted to the foundation table. The forces are all absorbed by the table with no forces resulting from the vacuum or partial vacuum acting on the spring elements of the foundation table.

Furthermore, the condenser can be supported in bearings in recesses of the foundation table so as to slide axially.

Such an arrangement makes it possible for the turbine and the condenser to use the same fastening mechanism.

According to further possible forms of construction of the fastening device, the bearings may be cast rigidly in the foundation table. Thermal expansion may be absorbed by the condenser jacket. The condenser may be suspended so as to slide axially on the foundation table or the condenser can be spring-supported.

A particular advantage results from the above-mentioned form of construction in which the bearings are cast rigidly in the foundation table. This advantage is that, in the opening of the foundation table for the condenser to turbine connection, a smooth recess can be provided whereby a flexible connection between the turbine and the condenser projects inward in the exhaust space.

According to the forms of construction in which the condenser is suspended so as to slide axially on the foundation table or so as to be spring-supported, it is advantageous that the completely assembled condenser can be both fastened on the foundation table and connected to the turbine in a simple manner.

BRIEF DESCRIPTION OF THE DRAWINGS

Preferred embodiments of the present invention are described with reference to the accompanying drawings wherein like elements bear like reference numerals and wherein.

DETAILED DESCRIPTION OF THE PREFERRED EMBODIMENTS

Figure 1:
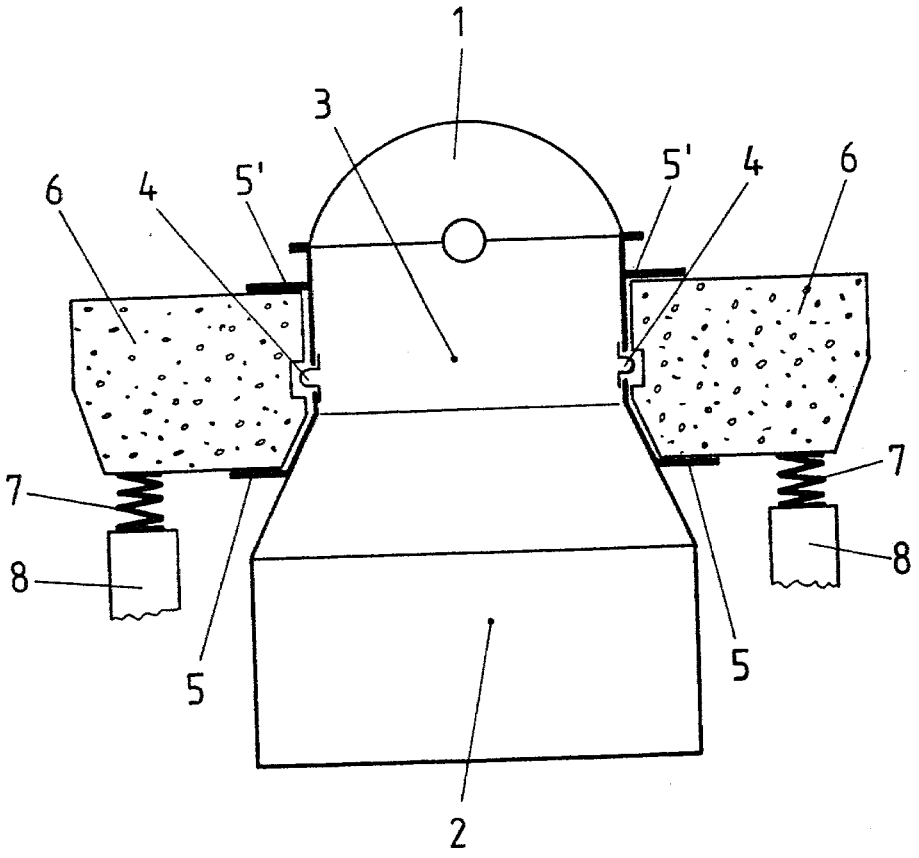
FIG. 1 is a cross sectional view of a fastening arrangement according to the present invention for a turbine and a condenser.

With reference to FIG. 1, a turbine 1 has a condenser 2 fastened to an exhaust space 3 of the turbine. The turbine and condenser are mounted by a plurality of bearings 5,5' on a foundation table 6. The table 6 is spring-supported by a plurality of springs 7 on a plurality of supports 8. The supports 8 are part of another supporting structure (not shown).

Figure 2:
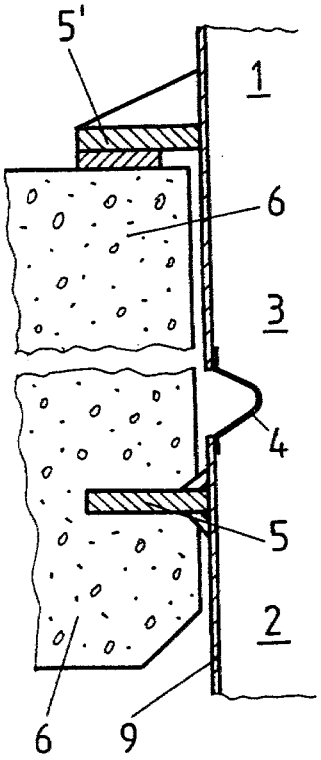
FIG. 2 is an enlarged view of a portion of the fastening arrangement of FIG. 1.

With reference now to FIG. 2, the bearings 5 for the condenser 2 may be cast rigidly in the foundation table 6. Thermal stresses which occur are absorbed by a condenser jacket 9 which is connected to the bearings 5. The flexible connection 4 provided between the turbine 1 and the condenser 2 is then passed into the exhaust space 3.

Figure 3:
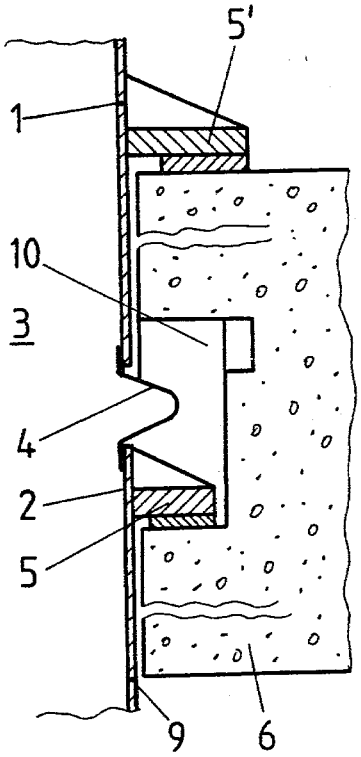
FIG. 3 is a view of a portion of another fastening arrangement according to the present invention.

In the embodiment illustrated in FIG. 3, one or more recesses 10 are provided in the foundation table 6. The bearings 5 of the condenser 2 are fastened to the foundation table 6 within the recesses while the bearings 5' of the turbine 1 are arranged on the upper side of the foundation table 6. The flexible connection 4 between the turbine 1 and the condenser 2 also projects into the recess 10. The bearing 5 of the condenser 2 is arranged in this embodiment so that axial shifts of the condenser 2 can be absorbed.

Figure 4:
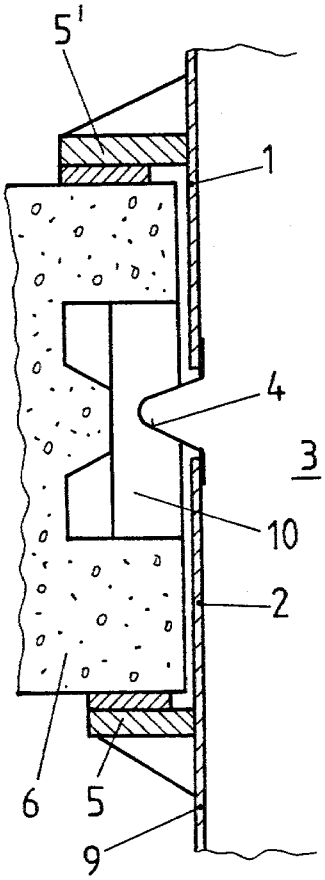
FIG. 4 is a view of a portion of still another fastening arrangement according to the present invention.

With reference now to FIG. 4, the bearing 5 of the condenser 2 is fastened on the underside of the foundation table 6. The bearing 5' is again fastened on the upper side of the foundation table 6. The flexible connection 4, however, is again arranged within the recess 10 of the foundation table 6.

Figure 5:
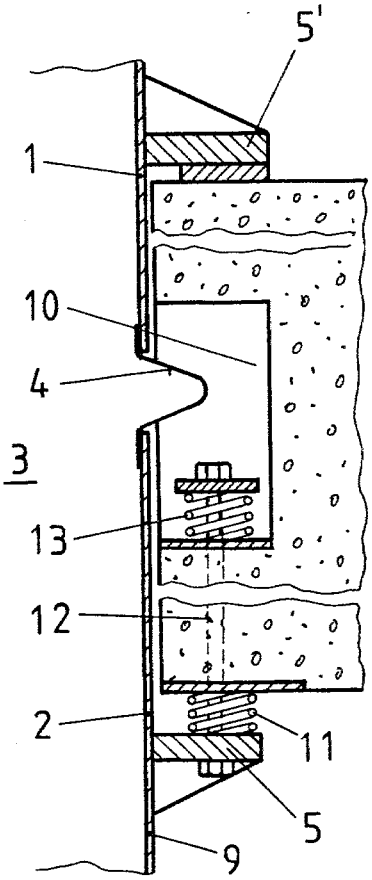
FIG. 5 is a view of a portion of yet still another fastening arrangement according to the present invention.

A still further possible construction of the fastening arrangement is evident from FIG. 5. In this embodiment, the condenser 2 is suspended on the foundation table 6 such that six supporting springs 11 (only one of which is illustrated) are arranged circumferentially about the condenser 2 between the bearings 5 and the foundation table 6. The springs 11 are connected by respective spring shackle bolts 12 with respective catch springs 13 which are arranged in the recesses 10. In this way, telescopic shock courses of the turbine and condenser can be limited. Such an arrangement enables an extensive decrease in vibration excitation occurring between the foundation table 6 and the condenser 2 with a dynamic load.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A fastening arrangement especially for a turbine and a condenser connected to an exhaust of the turbine, comprising:

a foundation table;

first means for fastening the turbine to the foundation table;

second means for fastening the condenser to the foundation table; and resilient means for resiliently mounting the foundation table on a support structure.

2. The fastening arrangement of claim 1 wherein the turbine and the condenser are flexibly attached to one another by a flexible connection.

3. The fastening arrangement of claim 1 wherein the means for fastening the condenser to the foundation table includes means for permitting the condensor to slide axially relative to the foundation table.

4. The fastening arrangement of claim 1 wherein the means for fastening the condenser to the foundation table includes at least one bearing member fixedly mounted in the foundation table.

5. The fastening arrangement of claim 4 wherein the foundation table is of concrete and wherein the at least one bearing member is cast in the concrete of the foundation table.

6. The fastening arrangement of claim 1 wherein the foundation table includes at least one recess, the means for fastening the condenser to the foundation table including at least one bearing member which is mounted within the at least one recess for axial movement.

7. The fastening arrangement of claim 1 wherein the means for fastening the condenser to the foundation table includes at least one bearing member provided at a bottom surface of the foundation table.

8. The fastening arrangement of claim 1 wherein the means for fastening the condenser to the foundation table includes at least one bearing member resiliently supported by the foundation table.

9. The fastening arrangement of claim 8 wherein the at least one bearing member supports the condenser and wherein the at least one bearing member is resiliently supported by the foundation table by at least one spring.

10. The fastening arrangement of claim 9 wherein the at least one bearing member is resiliently mounted to the foundation table by six shackle bolts arranged circumferentially about the condenser, each shackle bolt having a respective catch spring and a respective support spring.

11. The fastening arrangement of claim 2 wherein the flexible connection extends into a recess of the foundation table.

12. The fastening arrangement of claims 4, 5, 6, 7, 8, 9 or 10 wherein the means for fastening the turbine to the foundation table includes a second bearing member provided on a top surface of the foundation table.

* * * * *